United States Patent [19]

Stein et al.

[11] Patent Number: 4,924,103

[45] Date of Patent: May 8, 1990

[54] RADIATION PROTECTION APRON

[75] Inventors: Jeffrey Stein, Brooklyn; Ray C. Lapof, New York, both of N.Y.

[73] Assignee: Bar Ray Products, Inc., Brooklyn, N.Y.

[21] Appl. No.: 283,126

[22] Filed: Dec. 12, 1988

[51] Int. Cl.[5] ..... G21F 3/02; A41D 13/00; A42B 3/02

[52] U.S. Cl. ..... 250/516.1; 2/2; 2/411

[58] Field of Search ..... 250/516.1; 2/2, 46, 2/48, 51, 102, 243 R, 411, 412

[56] References Cited

U.S. PATENT DOCUMENTS

| | | | |
|---|---|---|---|
| 1,149,950 | 8/1915 | Rindskopf | 2/46 |
| 3,052,799 | 9/1962 | Hollands | 250/516.1 |
| 3,093,829 | 6/1963 | Maine | 250/516.1 X |
| 3,996,620 | 12/1976 | Maine | 2/48 X |
| 4,441,025 | 4/1984 | McCoy, Jr. | 250/516.1 |

*Primary Examiner*—Constantine Hannaher
*Assistant Examiner*—J. Eisenberg
*Attorney, Agent, or Firm*—Mark T. Basseches; Paula T. Basseches

[57] ABSTRACT

A flexible radiation shield apron is disclosed. A characterizing feature of the apron resides in the provision of an encasing fabric sleeve unconnected to the sheets providing radiation resistance, in the areas generally below the waist of the wearer whereby such portions of the apron readily bend with the movements of the wearer. Preferably the sheets providing radiation protection are separated at their peripheries by portions of the encasing fabric sleeve which intrudes between the perimeters of the sheets below the waist further to increase suppleness.

3 Claims, 1 Drawing Sheet

RADIATION PROTECTION APRON

BACKGROUND OF THE INVENTION

1. Field of the Invention

The present invention is directed to a radiation shield apron of the type employed by technicians and like persons exposed to radiation from X-rays and radioactive materials.

2. The Prior Art

It is conventional for technicians and other persons working in proximity to areas wherein they may be exposed to X-rays or radioactive materials to employ protective garments, frequently in the configuration of aprons or the like. A representative such garment is disclosed in U.S. Pat. No. 3052,799 of Sept. 4, 1962.

Garments of the type described are typically comprised of a layer or layers of vinyl or like plastics which are impregnated with radiation shielding materials, such as lead particles. In order to achieve the necessary barrier against radiation penetration and in view of the limited amount of lead which may be loaded into the plastic the protective sheets must necessarily be of substantial thickness. Such thicknesses dictate that the sheets, while formed of flaccid material, are nonetheless relatively stiff.

The sheets are typically encased in external fabric layers for the sake of appearance and in view of the relatively poor wear resistance of the lead loaded polymers.

In constructions heretofore known the fabric covering layers and the internal vinyl material have been stitched together throughout their periphery, a binder tape typically being overlaid about and stitched to the periphery for purposes of reinforcement and to provide a neat appearance.

Constructions in accordance with that described have proven cumbersome, tending to buckle rather than to conform to the body, for instance when the operator bends from the waist.

The above referenced United States patent attempts to solve the noted problem by providing a garment, the lower portion of which consists of two separate flaps or sheets which are independently encased in fabric, permitting one such flap to swing free of the other.

SUMMARY OF THE INVENTION

The present invention may be summarized as directed to an improved radiation apron construction wherein the apron, and particularly the portions of the apron below the waist, are largely free of the stiffness characteristics exhibited by the apron construction described above.

More particularly, we have discovered that in large measure the stiffness characteristics exhibited by known radiation aprons result from the differential expansion and contraction characteristics of the filled vinyl protected sheets on the one hand and the encasing fabric sleeve on the other hand, and the inability of the vinyl sheets and encasing fabric to slide relative to each other due to their being connected at edge areas below the waist. Thus, any bending of the apron results in the various layers flexing about different radii which, as with differential expansion, results in the formation of bulges and curls due to the edge constraints. Due to the existence of such curls, which typically run in a vertical direction, the garment assumes a stiffness characteristic which precludes the garment from bending about a horizontal fold line due to the stiffening effect of the curl.

In accordance with the invention, we have discovered that by permitting the lower portions of the polymer sheets to be unattached to each other and to any portion of the encasing fabric below the waist, the resultant garment is essentially free from the tendency to form bend-resistant curls and, hence, the same maintains the desired flexibility, assuring that the apron will flex or move with the bodily movements of the wearer.

It is accordingly an object of the invention to provide an improved radiation apron structure wherein the apron, and particularly the portions below the waist, remain compliant.

A further object of the invention is the provision of a garment of the type described which is attractive and inexpensive to manufacture as contrasted, for instance, with the garment as disclosed in the above referenced United States patent.

Figure 1:
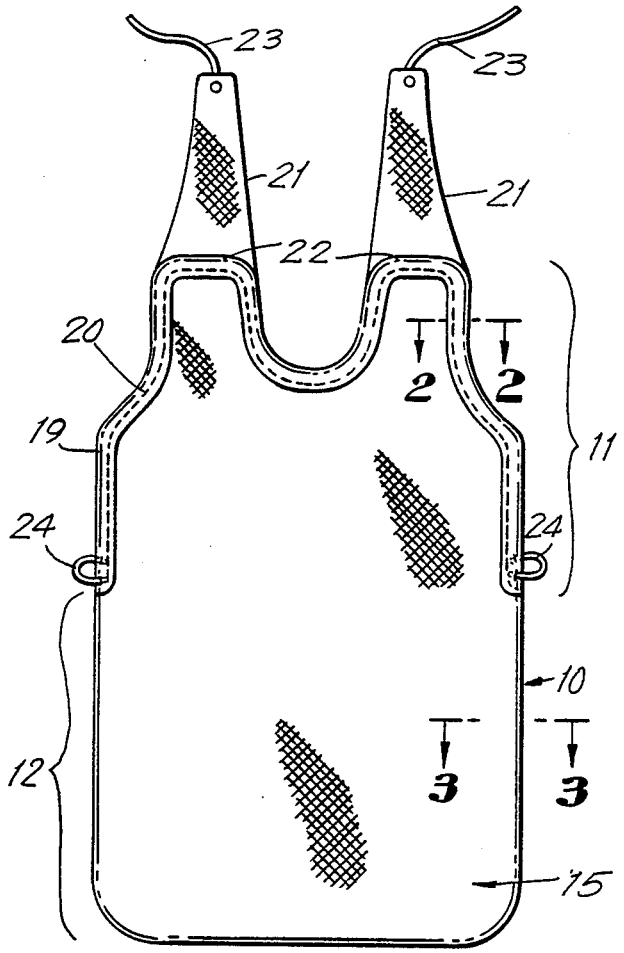
FIG. 1 is a front plan view of a radiation protection apron in accordance with the invention.
Figure 2:
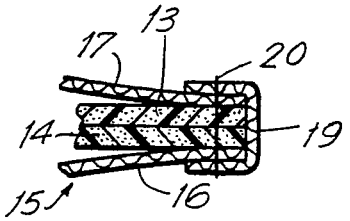
FIG. 2 is a magnified horizontal section taken on the line 2—2 of FIG. 1.

Referring now to the drawings, there is disclosed a radiation protection apron 10 which includes a bib portion 11 and a front panel portion 12, the term "bib portion" as used herein corresponding essentially to the portions of the garment which lie, in use, above the waist of the wearer, and the term "panel portion" as used herein referring to the apron portions generally below the waist.

The garment includes first and second congruent radiation shielding sheets 13, 14 formed of flaccid polymeric material of significant thickness, e.g. about 20 mils or more each, the material being typically comprised of a lead-filled vinyl. Each of the sheets is configured to conform to the shape of the bib and panel portions of the apron.

Sheets 13, 14 are encased within a sleeve of fabric 15, the sleeve being comprised of front and rear layers 16, 17, respectively.

The sleeve is formed by first stitching together layers 16, 17 along a first stitch line 18, which first stitch line joins the perimeters of the layers 16, 17 along the area up to the bib portion 11.

After formation of the stitch line 18, the layers are everted so that the formerly abutting surfaces of layers 16, 17 are now exposed at the exterior and the stitch line 18 lies interiorly of the sleeve.

The radiation shielding sheets 13, 14 are thereafter inserted into the bottom of the sleeve (the area 12), the sleeve and sheets preferably being of rectangular configuration in the area 12, the sleeve in such area being somewhat oversize to provide clearance around the periphery of the sheets. Thereafer a binding tape 19 is applied over the unconnected edges of the sleeve throughout the bib area 11 and a second stitch line 20 is formed which penetrates the bib, sleeve layers and sheets throughout the bib area. Thereafter, means are applied to the partially formed apron for enabling the same to be supported on the body of the wearer.

The attachment means, which are typically affixed to the reinforced binder 19 may, illustratively, comprise wings 21 secured to the uppermost ends 22 of the bib, the wings including ties 23. Anchor rings 24 may likewise be secured to the sides of the apron by attachment to the bib.

In use, the rings are disposed over the shoulders of the wearer and the ties passed in criss-cross fashion over the back of the wearer, passed through the rings 24, and connected in front of the apron.

The specific attachment means forms no part of the present invention and numerous alternate attachment mechanisms, such as belts, straps, Velco connectors, etc. may be suitably substituted for the wings 21, ties 23, and rings.

Figure 3:
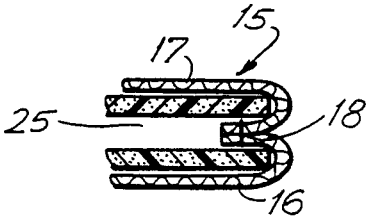
FIG. 3 is a magnified horizontal section taken on the line 3—3 of FIG. 1.

Preferably, as best seen in FIG. 3, the double thickness of fabric connected by the first stitch line 18 is disposed between the sheets 13, 14 throughout the area 12, whereby the sheets are separated as by space 25.

We have discovered that by virtue of the fact that the sheets 13, 14 are unconnected to each other or to the sleeve at points below the bib area 11, the portion 12 of the apron maintains a far higher degree of flexibility and capability of folding or moving in accordance with the bodily movements of the wearer than is the case in conventional constructions wherein the peripheral portions of the sheet or sheets in the area 12 are fixedly secured to each other and to the encasing fabric.

The flexibility of the apron in the area 12 is further augmented by maintaining the sheets 13, 14 in a separated condition by the interposition therebetween of the perimetal portions of the encasing sleeve, as shown in FIG. 3, since the somewhat tacky sheets are thus enabled to slide relative to each other.

From the foregoing it will be appreciated that there is disclosed an improved radiation shielding apron which is economical to produce and which evinces improved bending characteristics in the area beneath the bib border, rendering the garment more comfortable to the wearer since the same does not impede the movements of the wearer as is the case with conventional radiation aprons.

Numerous variations in details of construction may occur to those skilled in the art and familiarized with the instant disclosure. Accordingly, the same is to be broadly construed within the scope of the appended claims.

Having thus described the invention and illustrated its use, what is claimed as new and is desired to be secured by Letters Patent is:

1. A radiation protection apron comprising first and second congruent flaccid lead filled polymeric sheets configured to define a torso embracing bib portion extending substantially to the waist portion of a wearer and a front panel portion disposed below said bib portion, a fabric sleeve encompassing said sheets, said sleeve being configured to conform to the shape of said sheets, said sleeve being comprised of first and second congruent fabric layers stitched together along a stitch line generally coextensive with the margins of the front panel portion and terminating substantially at said bib portion, said layers being everted whereby said stitch line is disposed interiorly of said sleeve, the perimeters of said sheets forming said front panel portion being free of attachment to each other and said sleeve, a reinforcing binding web overlying the perimeter of the bib portion of said sleeve and the front and rear faces of said sleeve adjacent said perimeter, a second stitch line extending between the front and rear surfaces of said binding, said second stitch line extending through and linking said binding to said sheets and the front and rear surfaces of said sleeve, and attachment means secured to said binding, sheets and sleeve at the upper end of said bib portion for securing said apron over the shoulders of a wearer.

2. An apron in accordance with claim 1 wherein perimetal portions of said sleeve intervene between and separate the perimeters of said sheets in said panel portion.

3. An apron in accordance with claim 2 wherein said attachment means comprise a pair of wings affixed to the uppermost end of said bib portion, said wings including tie means at the end remote from said bib, said attachment means including anchor rings disposed at opposite sides of said apron generally at the lowermost extremity of said bib.

* * * * *